US009487278B2

(12) United States Patent
Snow

(10) Patent No.: US 9,487,278 B2
(45) **Date of Patent: *Nov. 8, 2016**

(54) TRIM TAB ASSEMBLY

(71) Applicant: Marine 1, LLC, New Baltimore, MI (US)

(72) Inventor: Scott Snow, Commerce, MI (US)

(73) Assignee: Marine 1, LLC, Commerce, MI (US)

( * ) Notice: Subject to any disclaimer, the term of this patent is extended or adjusted under 35 U.S.C. 154(b) by 18 days.

This patent is subject to a terminal disclaimer.

(21) Appl. No.: 14/208,914

(22) Filed: Mar. 13, 2014

(65) Prior Publication Data

US 2014/0190388 A1 Jul. 10, 2014

Related U.S. Application Data

(63) Continuation of application No. 13/709,476, filed on Dec. 10, 2012, now Pat. No. 8,707,884, which is a continuation of application No. 12/547,299, filed on Aug. 25, 2009, now Pat. No. 8,327,790.

(60) Provisional application No. 61/091,451, filed on Aug. 25, 2008.

(51) Int. Cl.
*B63B 1/22* (2006.01)
*B63B 39/06* (2006.01)

(52) U.S. Cl.
CPC ..... *B63B 39/061* (2013.01)

(58) Field of Classification Search
CPC ..... B63B 39/00; B63B 39/061
USPC ..... 114/284–286
See application file for complete search history.

(56) References Cited

U.S. PATENT DOCUMENTS

| | | | | |
|---|---|---|---|---|
| 5,310,369 | A | 5/1994 | Kobayashi | |
| 5,881,666 | A * | 3/1999 | Crews, Jr. | 114/285 |
| 6,089,177 | A | 7/2000 | Muller | |
| 6,524,146 | B2 * | 2/2003 | Spade et al. | 440/41 |
| 7,174,843 | B1 * | 2/2007 | Tossavainen | 114/284 |

(Continued)

FOREIGN PATENT DOCUMENTS

| | | |
|---|---|---|
| DE | 19753926 C1 | 5/1999 |
| DE | 19837888 C1 | 2/2000 |

(Continued)

OTHER PUBLICATIONS

International Search Report and Written Opinion for PCT Application No. PCT/US2009/054902 mailed Apr. 2, 2010; 8 pages.

*Primary Examiner* — Daniel V Venne

(57) ABSTRACT

A trim tab assembly including a hinge assembly and a trim tab. The trim tab includes a wedge-shaped body with a curved surface and a side. The curved surface, while in a deployed state, adjusts pitch, roll or yaw motion of a marine vessel. The curved surface is pivoted about a portion of the hinge assembly when transitioned between retracted and deployed states. A first portion of the curved surface extends below the marine vessel while in the deployed state and deflects oncoming water when a portion of the curved surface is extended below the marine vessel. A second portion of the curved surface is not below the marine vessel while in the deployed state. The hinge assembly is configured to attach to a support structure of the marine vessel rearward of the curved surface. The side extends between the curved surface and the hinge assembly.

1 Claim, 9 Drawing Sheets

(56) References Cited

U.S. PATENT DOCUMENTS

| | | | | |
|---|---|---|---|---|
| 8,327,790 | B2 | 12/2012 | Snow | |
| 8,707,884 | B2 * | 4/2014 | Snow | 114/285 |
| 2005/0126466 | A1 | 6/2005 | Moore et al. | |
| 2007/0101920 | A1 * | 5/2007 | Loui et al. | 114/285 |
| 2014/0190387 | A1 * | 7/2014 | Snow | 114/285 |

FOREIGN PATENT DOCUMENTS

| | | | |
|---|---|---|---|
| JP | 06-037200 | | 5/1994 |
| JP | 07-165185 | | 6/1995 |
| JP | 2001-294197 | | 10/2001 |
| WO | WO-9824684 | A1 | 6/1998 |
| WO | WO-2010-027791 | A2 | 3/2010 |

* cited by examiner

TRIM TAB ASSEMBLY

CROSS-REFERENCE TO RELATED APPLICATIONS

The present disclosure is a continuation application of U.S. patent application Ser. No. 13/709,476 filed on Dec. 10, 2012, which is a continuation application of U.S. patent application Ser. No. 12/547,299 filed Aug. 25, 2009 (now U.S. Pat. No. 8,327,790). This application claims the benefit of U.S. Provisional Application No. 61/091,451 filed Aug. 25, 2008. The entire disclosures of the applications referenced above are incorporated herein by reference.

FIELD

The disclosure relates to trim tabs for marine vessels.

BACKGROUND

Generally current prior art trim tabs may be attached to a vessel on an outside of the hull. Prior art trim tabs do not move at a rate sufficient to dampen motion of a vessel. Prior art trim tabs typically require running lines and hoses through the hull to actuate the trim tabs. Additionally current trim tabs may require bulky actuators that are not easily integrated into a vessel. Further current trim tabs may require large forces to actuate the tabs. There is therefore a need in the art for an improved trim tab that is easily integrated into a vessel and solves the problems of the prior art.

SUMMARY

A trim tab assembly is provided and includes a hinge assembly and a trim tab. The trim tab includes a wedge-shaped body. The wedge-shaped body includes a curved surface and a side. The curved surface, while in a deployed state, adjusts pitch, roll or yaw motion of a marine vessel. The curved surface is pivoted about a portion of the hinge assembly when transitioned between a retracted state and the deployed state. A first portion of the curved surface (i) extends below the marine vessel while in the deployed state, and (ii) deflects oncoming water when at least a portion of the curved surface is extended below the marine vessel. A second portion of the curved surface is not below the marine vessel while in the deployed state. The hinge assembly is configured to attach to a support structure of the marine vessel rearward of the curved surface. The side extends between the curved surface and the hinge assembly. The curved surface and the side define at least a portion of the wedge-shaped body.

In one aspect there is disclosed a trim tab assembly for a watercraft that includes an enclosure. A support structure is positioned in the enclosure. At least one trim tab is disposed in the enclosure. An electric actuator is linked to the trim tab pivotally moving the trim tab relative to the enclosure. The electric actuator is positioned on a dry side relative to the enclosure.

In another aspect, there is disclosed a trim tab assembly for a watercraft that includes an enclosure. A support structure is positioned in the enclosure. At least one trim tab is disposed in the enclosure. The trim tab includes a generally planar top, bottom, side and front surfaces linked by a curved surface defining a wedge shaped body. An actuator is linked to the trim tab pivotally moving the trim tab relative to the enclosure.

DETAILED DESCRIPTION

Differential and differentially are defined within this document as unequal, off center and/or involving differences in: angle, speed, rate, direction, direction of motion, output, force, moment, inertia, mass, balance, application of comparable things, etc.

Differential and differentially are defined within this document as unequal, off center and/or involving differences in the angle, speed, rate, direction, direction of motion, output, force, moment, inertia, mass, balance, application of comparable forces, etc.

Dynamic and dynamically may be defined as the immediate action that takes place at the moment they are needed. Immediate, in this application, means that the control action occurs in a manner that is responsive to the extent that it prevents or mitigates vessel motions and attitudes before they would otherwise occur in the uncontrolled situation. Someone skilled in the art understands the relationship between sensed motion parameters and required effector response in terms of the maximum overall delay that can exist while still achieving the control objectives. Dynamic may be used in describing interactive hardware and software systems involving differing forces and may be characterized by continuous change and/or activity. Dynamic may also be used when describing the interaction between a vessel and the environment. As stated above, marine vessels may be subject to various dynamic forces generated by its propulsion system as well as the environment in which it operates.

Figure 1:
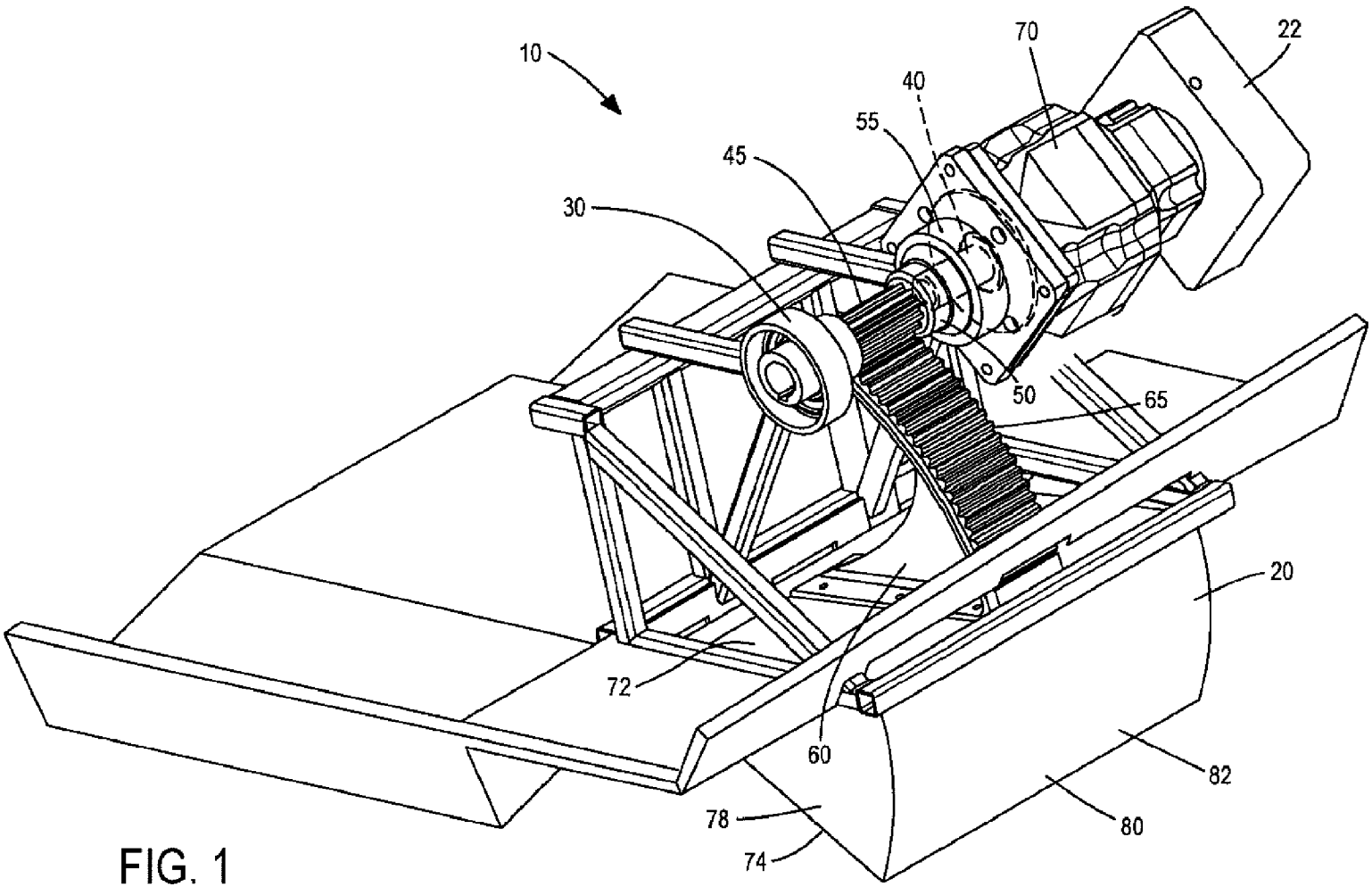
FIG. 1 is a partial perspective view of a trim tab assembly for a watercraft having a trim tab in a deployed position.

A vessel attitude may be defined as relative to three rotational axes, as detailed in FIG. 1 including pitch attitude or rotation about the Y, transverse or sway axis, roll attitude or rotation about the X, longitudinal or surge axis, and yaw attitude or rotation about the Z, vertical or heave axis.

Someone skilled in the art understands that active marine vessel damping is the attenuation of the value of a resonant response, such as the pitch, roll and yaw of the vessel. Someone skilled in the art understands that a marine vessel active stabilization, motion damping and attitude control system is a system selected, sized and integrated, based on a vessel's specific design, to achieve the effector rates required for damping pitch and/or roll and/or yaw.

Someone skilled in the art understands, for motion damping to be achieved, effector angular motion rates may generally be at least 10 times the vessel angular motion rate in the pitch and roll axis. For example, angular motion rates of 4 degrees per second may be typical of conventional high performance planning craft. This means that effector angular motion rates of 40 degrees per second may be used to achieve motion damping for this specific performance class of planning craft.

Someone skilled in the art understands, a hydrofoil, planning device and/or interceptor produces control forces based on a speed-squared relationship and are therefore much more effective at higher speeds than lower speeds. For example, a trim tab produces 4 times the amount of force at 20 knots than it does at 10 knots.

Figure 3:
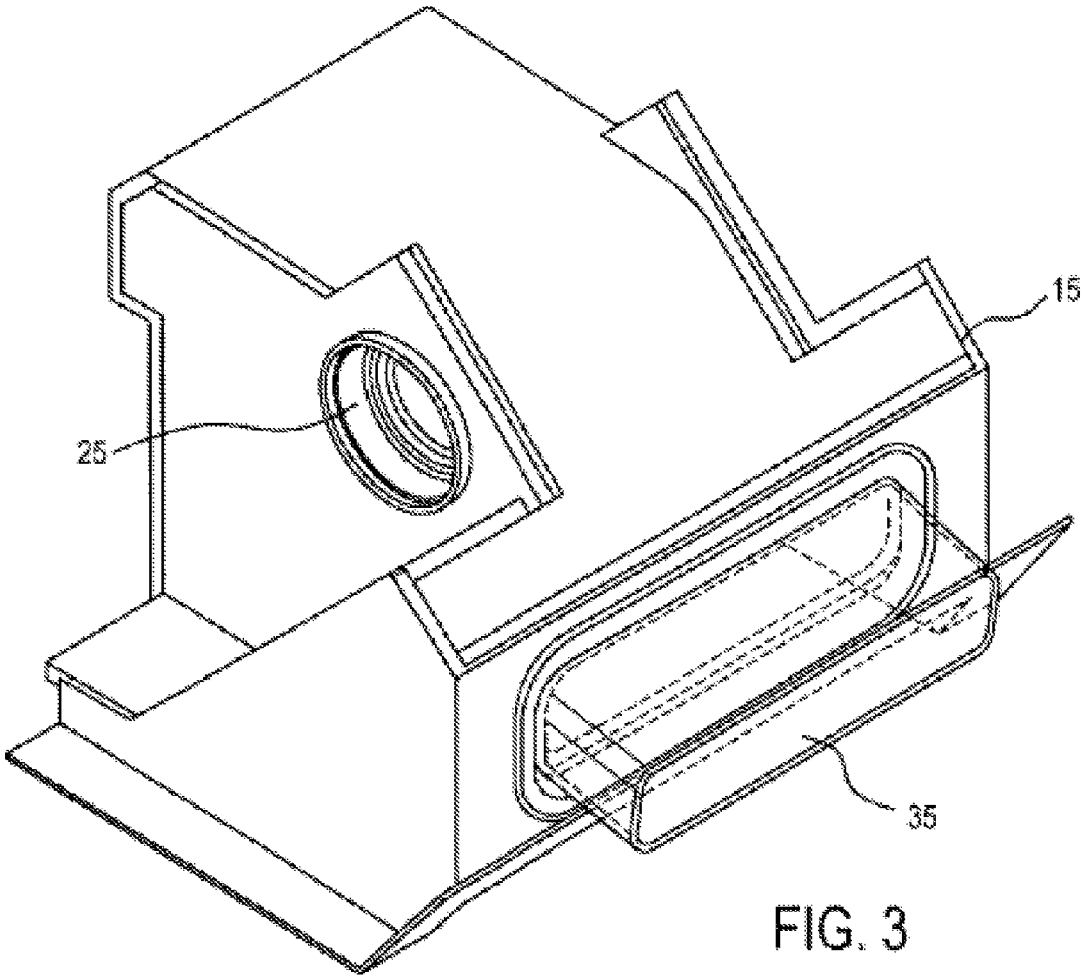
FIG. 3 is a perspective view of an enclosure for a trim tab assembly for a watercraft.

Referring to the figures, there is shown a trim tab assembly 10 for a watercraft. The trim tab assembly 10 may include an enclosure 15 or shell structure, as best shown in FIG. 3. The enclosure 15 may be linked with or joined with a support structure 30, to form a module that may be positioned within a hole formed in a watercraft. Alternatively, the enclosure 15 may be an opening formed within the hull in which the support structure 30 is disposed. Alternatively, the tab assembly 10 may be modular within a self-contained structure that may be attached to a vessel. At least one trim tab 20 is disposed within the enclosure 15. An electric actuator 22 may be linked with the trim tab 20 pivotally moving the trim tab 20 relative to the enclosure 15. The electric actuator 22 may be positioned on a dry side not exposed to water relative to the enclosure 15.

Referring to FIG. 3, there is shown one embodiment of an enclosure 15 for use in the trim tab assembly 10. As can be seen in the figure, the enclosure 15 is sized and shaped to accommodate the trim tab assembly 10. The enclosure 15 may include holes 25 formed therein for accommodating various components of the trim tab assembly 10, as discussed in more detail below. Additionally, the enclosure 15 may also include a pressure relief orifice 35 formed therein that allows for release of air and water pressure created by movement of the trim tab 20 within the enclosure 15 during actuation.

Referring to the figures, the trim tab assembly 10 may include an electric actuator 22 having a driveshaft 40 that is connected to a drive gear 45. At least one bearing 50 supports the driveshaft 40 in the support structure 30. In one aspect, the at least one bearing 50 includes a seal 55 preventing water disposed within the enclosure 15 from exiting the cavity 15. Additionally, the seal 55 isolates the electric actuator 22 that is positioned on a dry side of the enclosure 15 from the water. A position sensor 89 best seen in FIGS. 10, 11 and 12-16 may be attached to the drive shaft 40 to monitor a position of the trim tab 20 relative to the enclosure 15. The position sensor 89 may include a potentiometer or equivalent device used to communicate position data to a central control computer. Alternatively, the electric actuator 22 may include a position sensor integrated with the motor.

Again referring to figures, the trim tab assembly 10 may include a driven member 60 that is attached to the trim tab 20 and is operably linked with the drive gear 45. In one aspect, the driven member 60 may include a flexible gear portion 65 attached to the driven member 60 and is meshed with the drive gear 45. In one aspect, the interface between the drive gear 45 and driven member 60 is a soft interface such that the gear teeth of the flexible gear portion 65 will shear upon application of a predetermined force preventing damage to a gearbox 70 of the electric actuator 22 as well as the driveshaft 40 and enclosure 15. It should be realized that the gear box may be eliminated as a separate component and may be integrated with the electric actuator 22. Additionally, the soft interface provides a joining of the drive gear 45 and driven member 60 without the need for lubrication. Such a dry relationship is advantageous when used in a wet environment within the enclosure 15.

Figure 9:
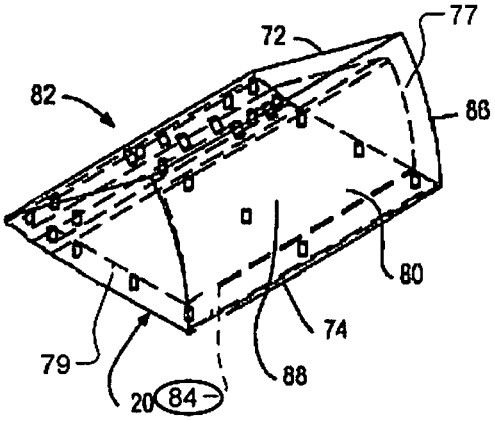
FIG. 9 is a view of the trim tab
Figure 10:
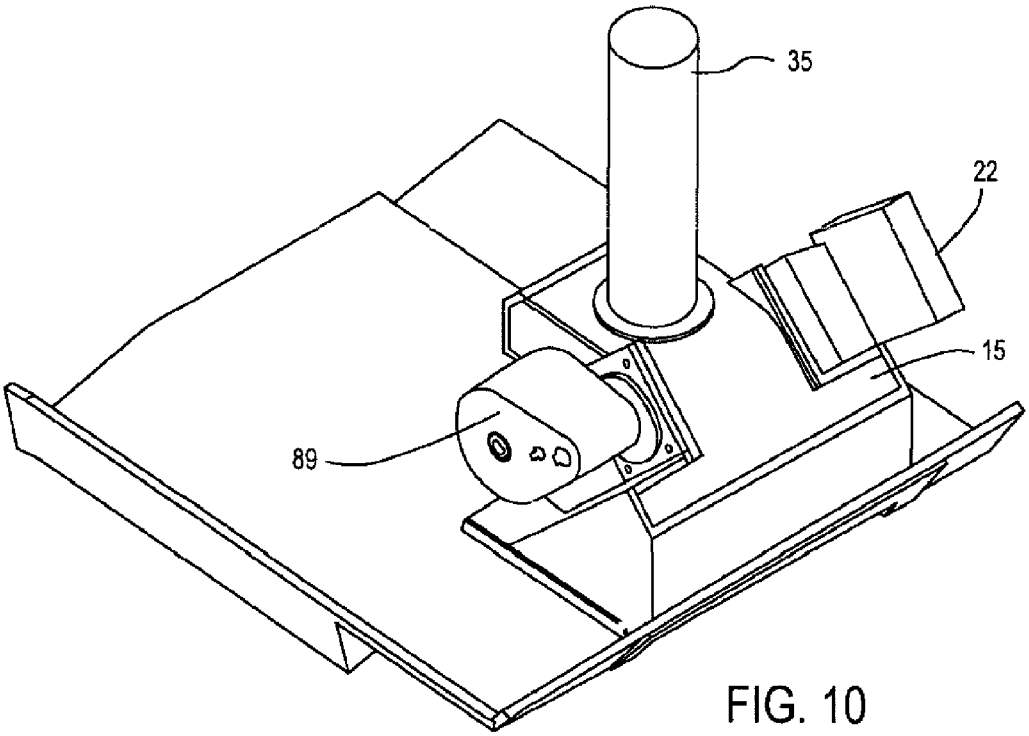
FIG. 10 is a view of an alternate embodiment of an enclosure having a pressure relief orifice.
Figure 11:
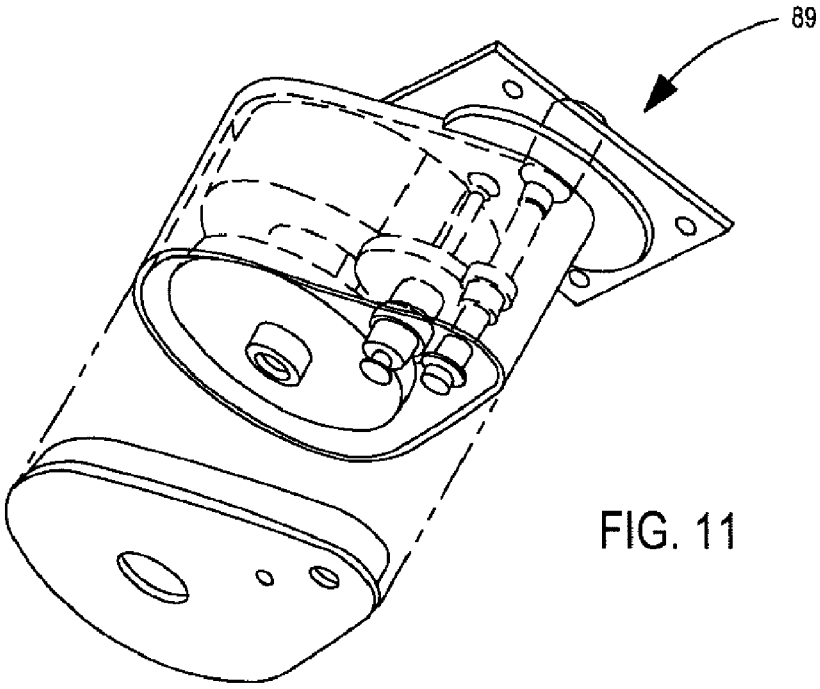
FIG. 11 is a view of a position sensor.
Figure 12:
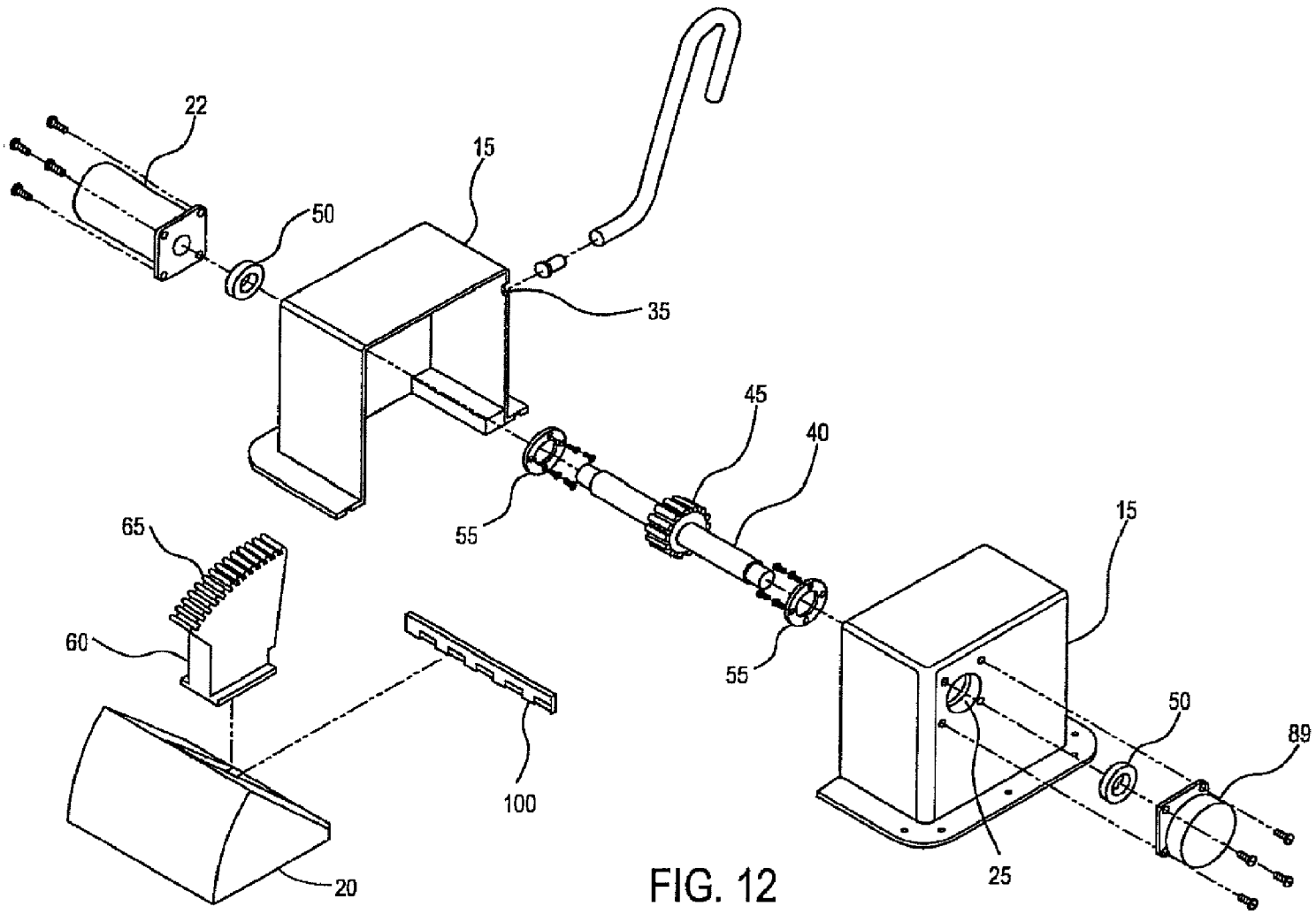
FIG. 12 is an exploded perspective view of the alternate embodiment of FIG. 4.
Figure 13:
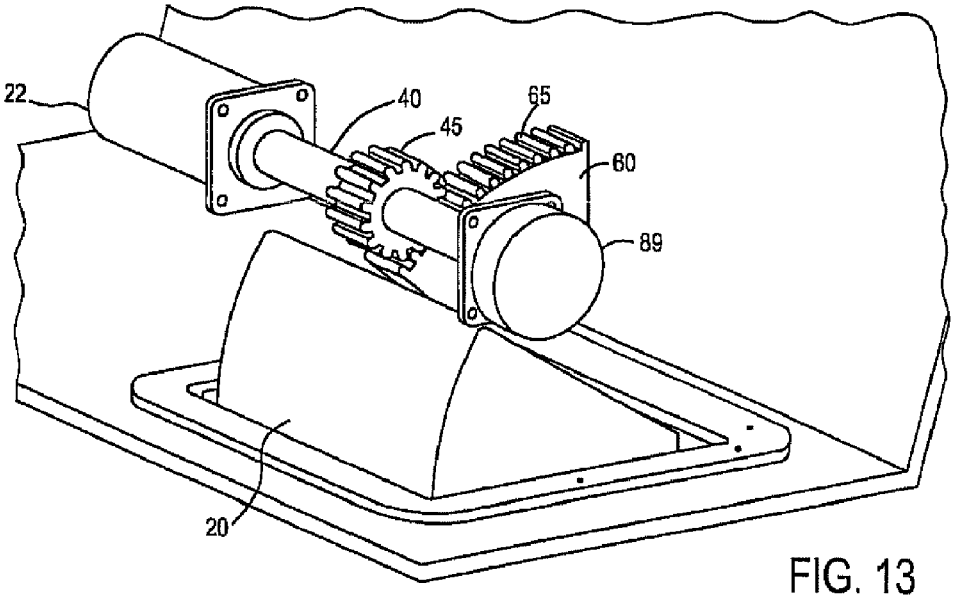
FIG. 13 is a perspective view of the alternate embodiment of FIG. 12 with the tab in the non-deployed position.
Figure 14:
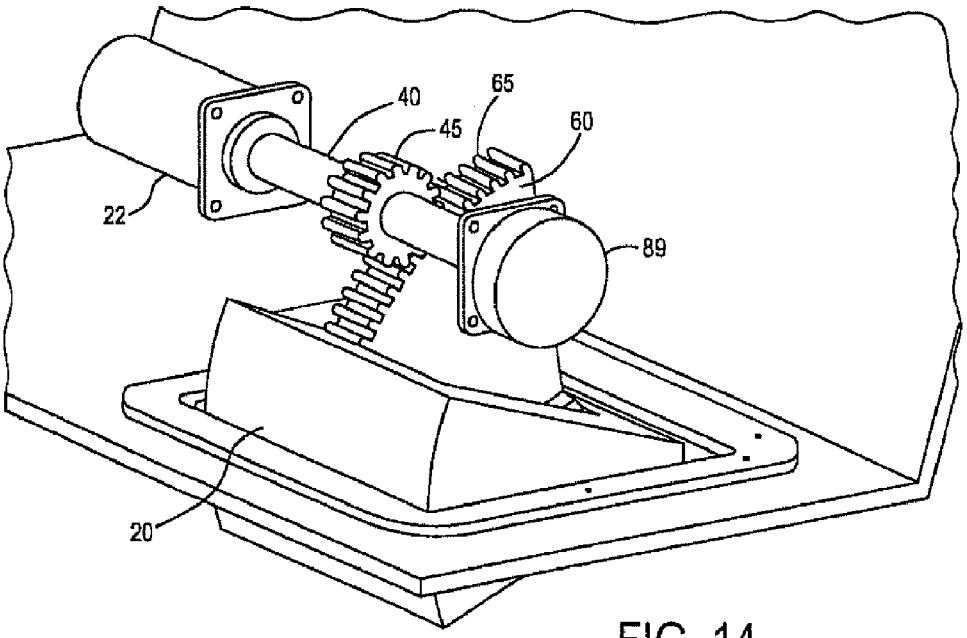
FIG. 14 is a perspective view of the alternate embodiment of FIG. 12 with the tab in an intermediate position.
Figure 15:
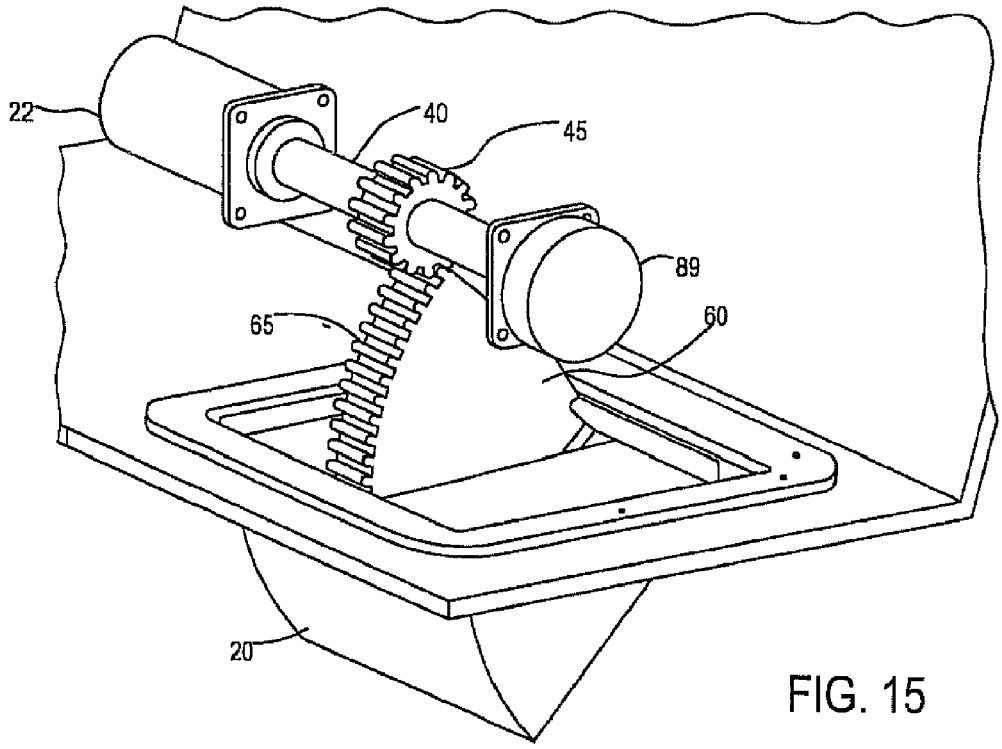
FIG. 15 is a perspective view of the alternate embodiment of FIG. 12 with the tab in the fully deployed position.
Figure 16:
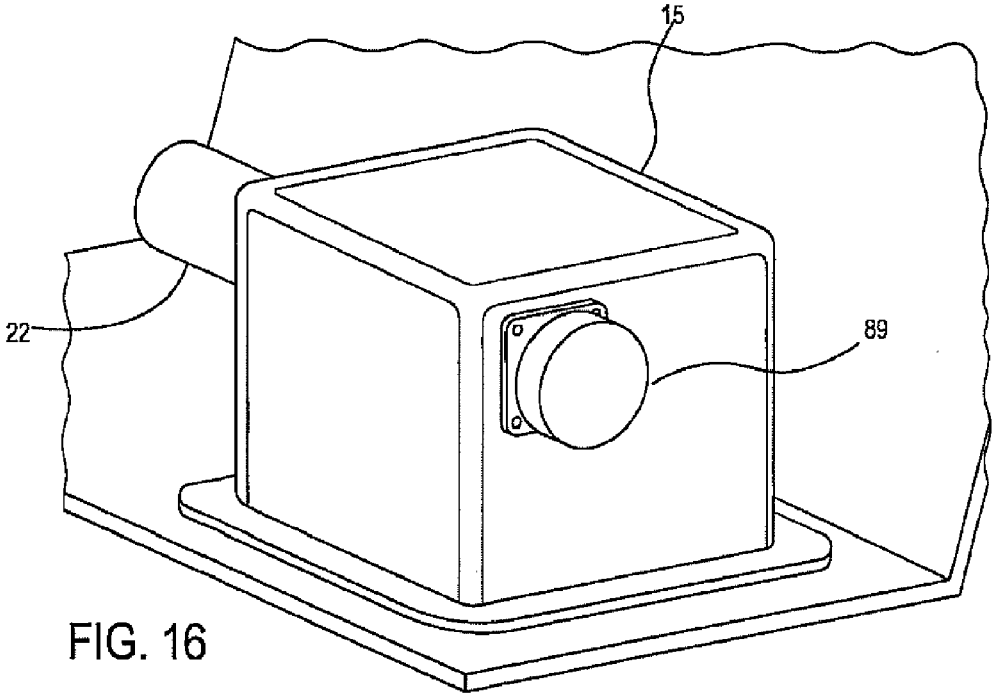
FIG. 16 is a perspective view of the alternate embodiment of FIG. 12 with the enclosure shown.

Referring to the various figures, in one aspect the trim tab 20 may include a generally planar top surface 72, bottom surface 74, and side surfaces 76 linked by a curved forward facing (or first) surface 80 defining a wedge-shaped body 82. In one aspect, as best seen in FIG. 9, the trim tab 20 may include an inner support structure 84 surrounded by an outer skin 86. The trim tab 20 may include: a first end 71 having a curved (or first) member 73 with the curved forward facing surface 80; a second end 75; a side (or second) member 77; and a side (or third) member 79. The first member 73 may have a top (or third) end 81 and a bottom (or fourth end) 83 with a bottom surface 91. The trim tab 20 may also include a side (or bottom) surface 87. The curved forward facing surface 80 and the member 73 extend outward from the hinge assembly 100 and upward from the fourth end 83 to the third end 81. In one aspect, the wedge shaped body 82 may include a buoyant material positioned within an interior 88 of the wedge-shaped body 82 providing support for the outer skin 86 as well as decreasing an overall weight of the trim tab 20. Various materials such as closed and open cell foams may be used in conjunction with additional support structure to withstand loads applied to a trim tab 20 during actuation and to provide buoyancy.

Figure 5:
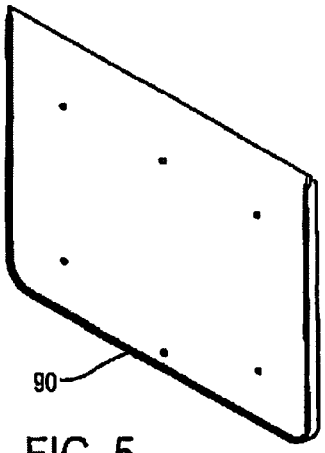
FIG. 5 is a view of a removable plate for attaching to a bottom surface of a trim tab.

In another aspect, and as shown in FIG. 5, a removable plate 90 may be attached to a water contacting surface of the trim tab 20. The removable plate 90 may include characteristics for modifying the performance characteristics of the trim tab 20. For example, the removable plate 90 may have various characteristics including concave shapes, convex shapes, and strakes of varying dimension and position, as well as shape surfaces that match the contour of a watercraft hull. In this manner, the removable plate 90 may be tailored to provide various design and performance characteristics that affect the overall performance of a watercraft having a trim tab assembly 10. Additionally, the removable plate 90 can be swapped out with another plate to provide various configurations that may be interchangeable to affect the performance of a watercraft.

Figure 2:
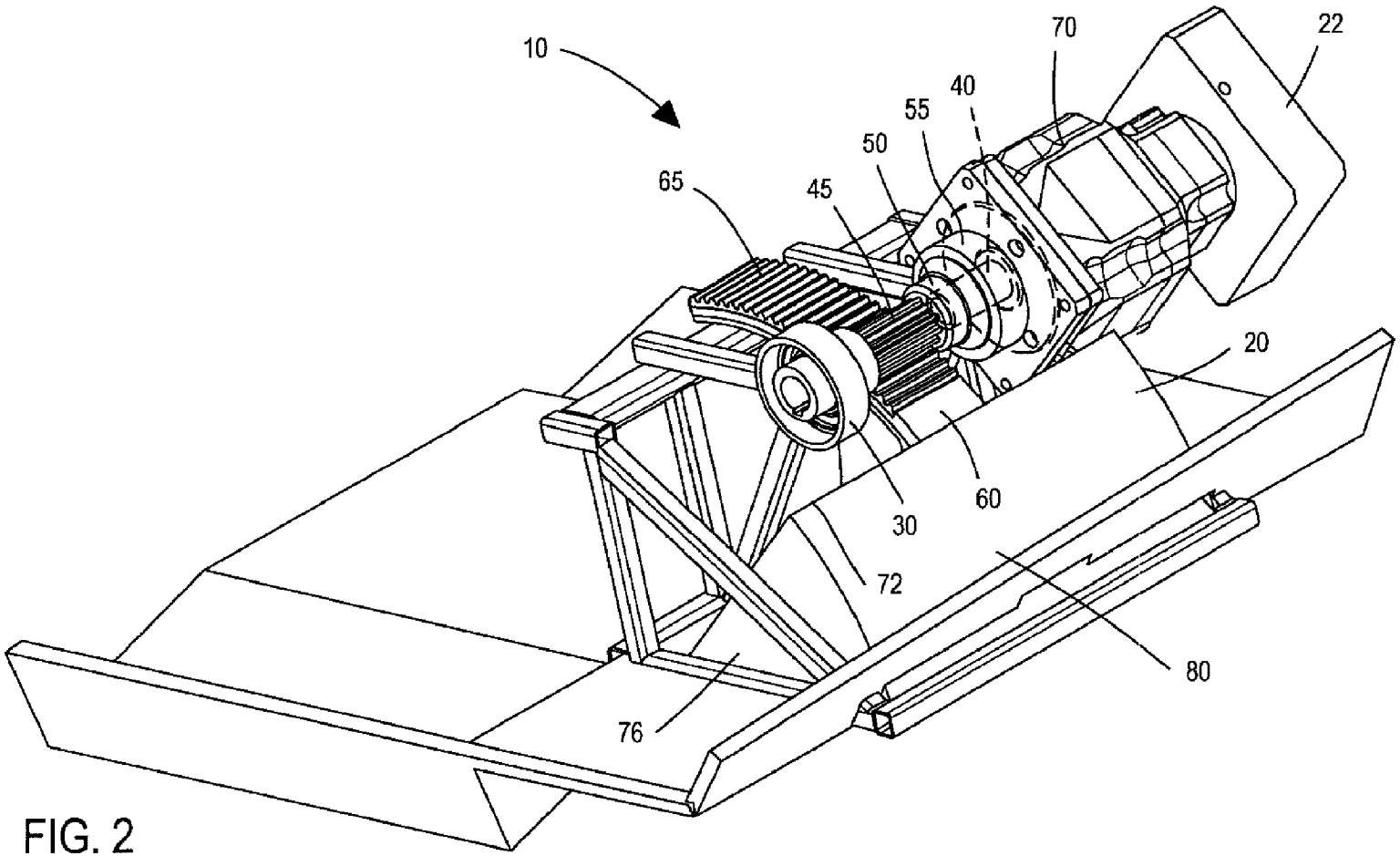
FIG. 2 is a partial perspective view of a trim tab assembly for a watercraft having a trim tab in a stowed position.
Figure 6:
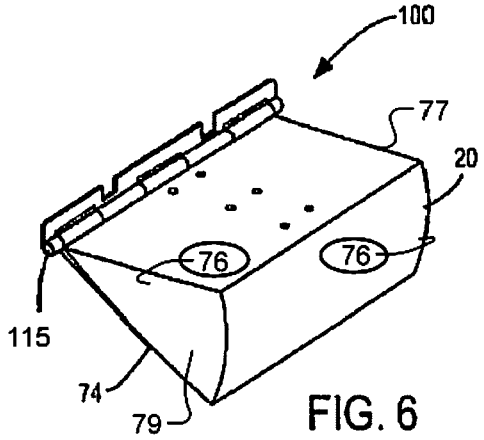
FIG. 6 is a view of the trim tab and hinge assembly.
Figure 7:
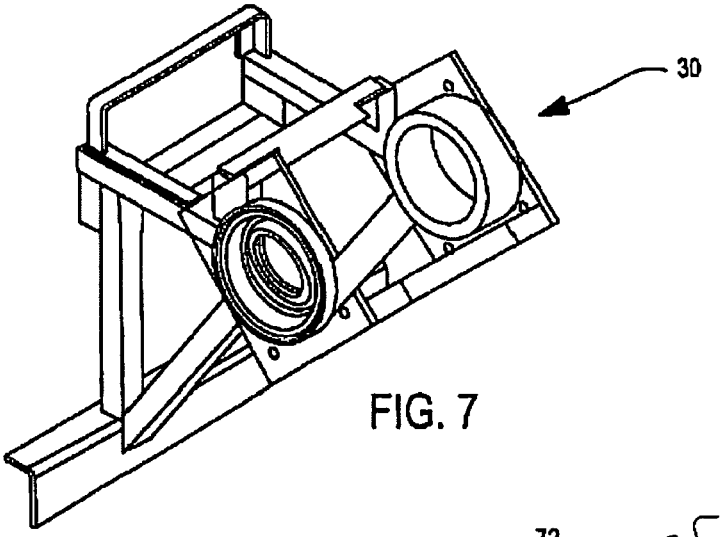
FIG. 7 is a view of the support structure.
Figure 8:
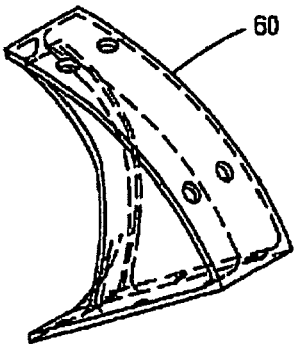
FIG. 8 is a view of the driven member.

Referring to FIGS. 1, 2 and 6, the trim tab assembly 10 may include a hinge assembly 100 that is linked to the enclosure 15 and the trim tab 20 for pivotal movement of the trim tab 20 relative to the enclosure 15. As shown in FIGS. 1 and 2, the hinge assembly 100 may be positioned on a forward edge of the enclosure 15 and linked with a forward portion of the trim tab 20. In one aspect, the hinge assembly 100 may be in two pieces such that one piece is attached to a bottom surface 74 of the trim tab 20 at a forward edge and is mated with a second piece attached to the support structure 30 disposed within the enclosure 15. A hinge pin 115 may be positioned along a center line of the hinge allowing pivotal movement of the trim tab 20 relative to the support structure 30 and enclosure 15.

In one aspect, the trim tab 20 may be positioned within the enclosure 15 in a close tolerance relationship preventing high pressure water created during tab deflection or extension from entering the enclosure 15. In this manner, high pressure water is prevented from contacting a low pressure top surface 72 of the trim tab 20 that is disposed within the enclosure 15. In one aspect, the trim tab 20 remains at least partially within the enclosure 15 when fully deployed to prevent foreign objects from entering the enclosure 15.

In use, the trim tab 20 is pivotally movable within the enclosure 15 to apply deflection forces to the water or obstruction of the water on which a watercraft is traveling to affect the performance of the watercraft. In one aspect, the trim tab 20 is actuated at speeds sufficient to counter motion rates and dampen motion in a pitch, steer and yaw axis of the watercraft. In one aspect, the trim tab 20 is actuated to control attitude changes in a pitch, steer and yaw axis of the watercraft.

In one aspect, the watercraft may include at least two trim tab assemblies 10 positioned within the watercraft. The trim tab assemblies 10 may be actuated in series, meaning that the at least two trim tab assemblies 10 actuate in the same manner at a given time. Alternatively, the at least two trim tab assemblies 10 may be actuated differentially wherein actuation of one of the trim tabs 20 is not the same as another to affect various forces on the watercraft to control the attitude, motion and dampen motion in the axes, as described above.

Figure 4:
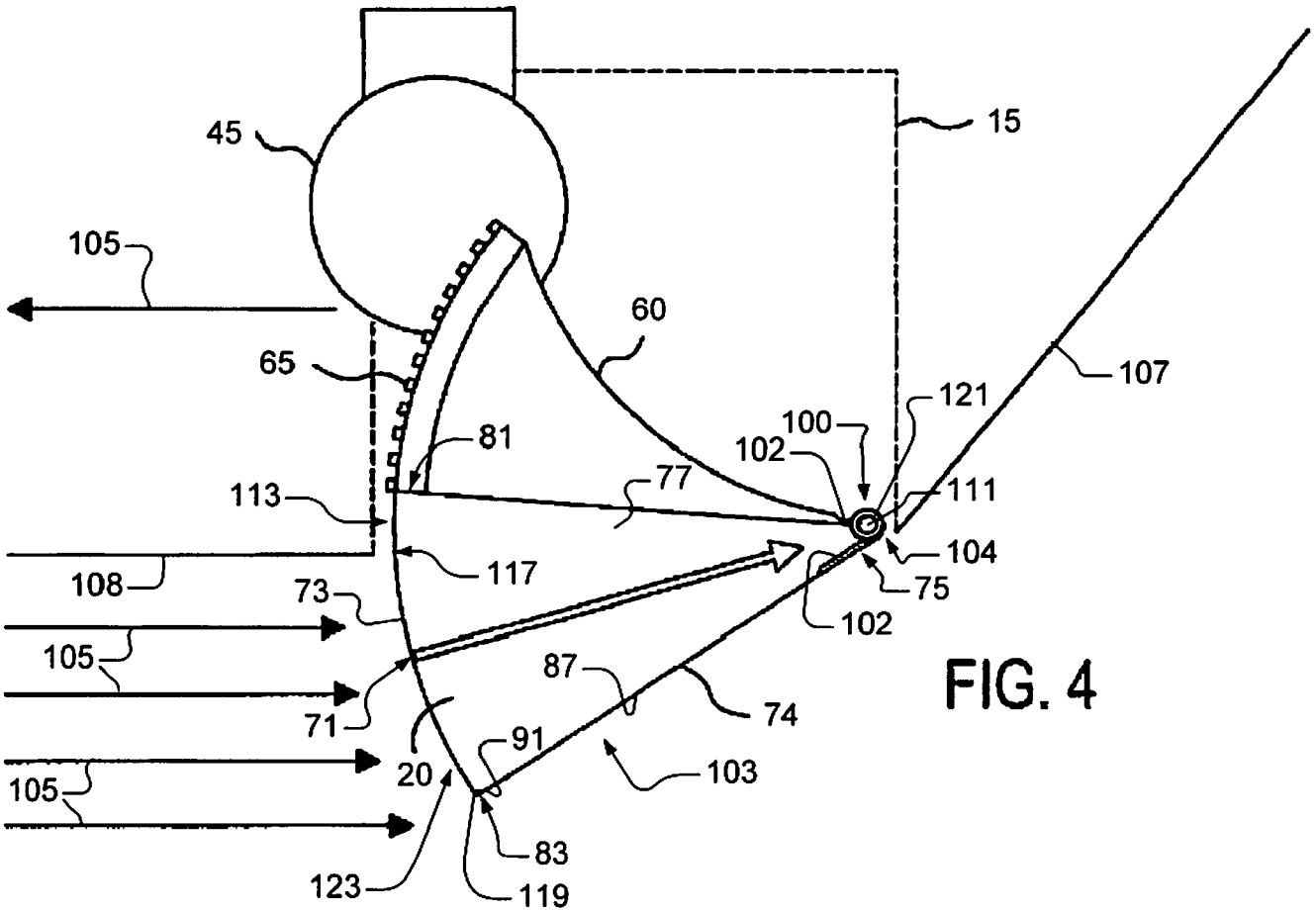
FIG. 4 is a view of an alternate embodiment of a trim tab assembly with a forward facing curved leading edge and its hinge placed aft.

Referring to FIGS. 4 and 12-16, there is shown an alternate embodiment of a trim tab assembly 10 including the same components described above except that the curved surface 80 of the trim tab 20 is positioned within the enclosure 15 in a forward facing position relative to the watercraft. The first member 73 is pivoted about a portion 121 and a center (or center point) 111 of the hinge assembly 100 from a fully retracted position to a fully deployed position. The first member 73 and the trim tab 20 are shown in an example fully extended (or deployed) state 103. The first member 73 is in an upright position during transitioning of the trim tab 20 between the fully retracted state and the fully extended (or deployed) state, because, during the transition, the third end 81 is above the fourth end 83. While being deployed (or in a deployed state), (i) the third end 81 is higher than the fourth end 83. Arrow 105 indicates motion of the marine vessel 107. The marine vessel 107 has a second (or bottom) surface 108. While in the extended (or deployed) state 103, a first portion 113 of the first member 73 is not below the second surface 108, as shown in FIG. 4. A second portion 123 of the first member 73 extends forward of the first portion 113 and away from the second end 75, also as shown in FIG. 4. While in state 103, the first end 71 extends at least from a first point 117, adjacent the bottom surface 108 of the marine vessel 107, to a second point 119 below the bottom surface of the marine vessel 107, also as shown in FIG. 4. Arrows 109 indicate motion of oncoming water relative to the marine vessel 107. Additionally, the hinge assembly 100, as described above, would be positioned at a rear edge 102 of the bottom surface 74 of the trim tab 20 and a rear 104 of the support structure 30 disposed within the enclosure 15. In this embodiment, the curved surface 80 contacts the water when actuated applying a force to the water and affecting a performance characteristic of a watercraft. In this position, the force needed to actuate the trim tab 20 is decreased in relation to the previously described first embodiment. As described above and as shown in the figures, the trim tab assembly 10 may include attachment devices. One attachment device (i.e. the actuator 22) is shown in FIG. 1. Another attachment device (i.e. the hinge assembly 100) is shown in FIG. 4. The hinge assembly 100 may include brackets 102 and/or a shaft 104. The member 73, by being convex-shaped and by extending downwardly into and deflecting oncoming water, adjusts roll, pitch, and/or yaw motion of the marine vessel 107.

The invention claimed is:

1. A trim tab assembly comprising:

a hinge assembly; and a trim tab comprising a wedge-shaped body, wherein the wedge-shaped body comprises a curved surface that, while in a deployed state, adjusts pitch, roll or yaw motion of a marine vessel, wherein the curved surface is pivoted about a portion of the hinge assembly when transitioned between a retracted state and the deployed state, a first portion of the curved surface (i) extends below the marine vessel while in the deployed state, and (ii) deflects oncoming water when at least a portion of the curved surface is extended below the marine vessel, a second portion of the curved surface is not below the marine vessel while in the deployed state, and the hinge assembly is configured to attach to a support structure of the marine vessel rearward of the curved surface, and a side extending between the curved surface and the hinge assembly, wherein the curved surface and the side define at least a portion of the wedge-shaped body.

* * * * *